US010766577B2

(12) United States Patent
Hansen

(10) Patent No.: US 10,766,577 B2
(45) Date of Patent: Sep. 8, 2020

(54) SYSTEM AND METHOD OF OPERATING A SUBSEA MODULE

(71) Applicant: OCEANEERING AS, Sandnes (NO)

(72) Inventor: Rune Hansen, Dimmelsvik (NO)

(73) Assignee: OCEANEERING AS, Sandnes (NO)

( * ) Notice: Subject to any disclaimer, the term of this patent is extended or adjusted under 35 U.S.C. 154(b) by 215 days.

(21) Appl. No.: 16/079,968

(22) PCT Filed: Nov. 25, 2016

(86) PCT No.: PCT/NO2016/050240
§ 371 (c)(1),
(2) Date: Aug. 24, 2018

(87) PCT Pub. No.: WO2017/146583
PCT Pub. Date: Aug. 31, 2017

(65) Prior Publication Data

US 2019/0054982 A1 Feb. 21, 2019

(30) Foreign Application Priority Data

Feb. 26, 2016 (NO) ..... 20160328

(51) Int. Cl.
*B63B 27/16* (2006.01)
*B63C 11/52* (2006.01)
(Continued)

(52) U.S. Cl.
CPC ..... *B63B 27/16* (2013.01); *B63B 27/10* (2013.01); *B63C 11/52* (2013.01); *B63G 8/001* (2013.01);
(Continued)

(58) Field of Classification Search
CPC ... B63B 27/16; B63B 27/10; B63B 2027/165; B63C 11/52; B63G 8/001; B63G 2008/004; B63G 2008/007; B66C 23/52
See application file for complete search history.

(56) References Cited

U.S. PATENT DOCUMENTS 3,536,023 A * 10/1970 Bascom ..... B63B 27/36 114/259
4,625,805 A * 12/1986 Ladecky ..... E21B 41/04 166/341
(Continued)

FOREIGN PATENT DOCUMENTS

EP 2 468 620 A1 6/2012
EP 2 921 445 A1 9/2015
(Continued)

OTHER PUBLICATIONS

International Search Report and Written Opinion dated Mar. 10, 2017 issued in International Application No. PCT/NO2016/050240.
(Continued)

*Primary Examiner* — Stephen P Avila
(74) *Attorney, Agent, or Firm* — Arent Fox LLP

(57) ABSTRACT

A system for managing and controlling a subsea module is described herein. The system includes a deployment module configured to releasably receive and accommodate the subsea module and a load-bearing cable. One end of the load-bearing cable is connected to the subsea module and the other end is connected to a cable control device on the deployment module. The subsea module may be lowered out of and retracted into the deployment module. The subsea module may be configured to hold a subsea vehicle, such as a remotely operated vehicle or autonomous underwater vehicle. The subsea module may also be a remotely operated tool.

21 Claims, 9 Drawing Sheets

(51) Int. Cl.

| | |
|---|---|
| ***B63B 27/10*** | (2006.01) |
| ***B63G 8/00*** | (2006.01) |
| ***B66C 23/52*** | (2006.01) |

(52) U.S. Cl.
CPC ..... *B66C 23/52* (2013.01); *B63B 2027/165* (2013.01); *B63G 2008/004* (2013.01); *B63G 2008/007* (2013.01)

(56) References Cited

U.S. PATENT DOCUMENTS

| | | | | |
|---|---|---|---|---|
| 2006/0201679 | A1* | 9/2006 | Williams | E21B 33/047 166/344 |
| 2012/0132875 | A1* | 5/2012 | Crawford | E21B 19/22 254/266 |
| 2015/0233202 | A1* | 8/2015 | Caldwell | E21B 33/064 166/340 |
| 2015/0315867 | A1* | 11/2015 | Caldwell | E21B 41/0014 166/345 |

FOREIGN PATENT DOCUMENTS

| | | | |
|---|---|---|---|
| GB | 2 004 818 | A | 4/1979 |
| WO | WO 01/21476 | A1 | 3/2001 |

OTHER PUBLICATIONS

Norwegian Search Report dated Sep. 16, 2016 issued in corresponding Norwegian Application No. 20160328.

* cited by examiner

SYSTEM AND METHOD OF OPERATING A SUBSEA MODULE

CROSS-REFERENCE TO RELATED APPLICATIONS

This application is a 35 U.S.C. § 371 National Phase of PCT Application No. PCT/NO2016/050240 filed Nov. 25, 2016, which claims priority to Norwegian Application No. NO 20160328 filed Feb. 26, 2016. The disclosures of these prior applications are hereby incorporated by reference herein.

FIELD OF THE INVENTION

The invention concerns the field of unmanned underwater vehicles. In particular, the invention concerns a system as set out by the preamble of claim 1, and a method of operating the system, as set out by the preamble of claim 13.

BACKGROUND OF THE INVENTION

Unmanned vehicles are widely used in underwater (also referred to as subsea) operations. Autonomous underwater vehicles (AUVs) and remotely operated vehicles (ROVs) are used for military operations, monitoring marine life, surveying seabed geology and archeology, salvage operations, as well as a multitude of tasks in connection with the extraction of hydrocarbons from subsea wells.

An AUV is generally a pre-programmed robot which is capable of operating under water without any real-time input from an operator.

An ROV is generally an unmanned, highly maneuverable, subsea mobile vehicle, having propulsion devices (e.g. thrusters) and equipment such as torque tools, manipulator arms (including cutters and grippers), cameras (video and stills), lights, sampling devices, etc. An ROV is normally connected to a device often referred to as a tether management system (TMS) via a neutrally buoyant tether. The tether containing electrical conductors and fiber optics for communicating electrical power, video signals, and data signals. The TMS typically comprises a cage holding a reel for storing and paying out tether, and may also comprise means for temporarily securing the ROV.

In use, the TMS is normally suspended (from e.g. a ship's crane) by a load-bearing umbilical cable which also contains power and communication means. The umbilical cable extends between the TMS and a control room aboard a surface ship, from where the ROV is controlled. The TMS is normally suspended in the water during ROV operations, below the splash zone.

Subsea operations in general also rely on extensive use of tools, units and equipment, many of which are remotely operated (e.g. by ROV's). Examples of such operations are BOP intervention, wellhead maintenance, and well intervention.

Such subsea operations, including the operation of the TMS and ROV, require considerable equipment and ancillary systems; for example a Power Distribution Unit (PDU), Hydraulic Power Unit (HPU), Instrumentation Power Assembly (IPA) and a Launch-and-Recovery System (LARS), a control room and various instruments and control interfaces. These systems and equipment are normally installed at the location of operation (e.g. on a vessel, a platform or a drilling rig), often in containers or on skids. This equipment, in addition to the ROV and the TMS, requires extensive logistics and often takes several days or weeks to mobilize to the intended location. It occupies a significant area and (in the case of a floating vessel) allowable variable deck load.

It is therefore a need for an improved system and method of performing these subsea operations.

The prior art includes WO 01/21476 A1, which discloses an AUV which is releasably connected to a flying latch vehicle. The vehicle is connected via a tether to a subsea tether management system (TMS). The TMS is connected via a load-bearing umbilical cable to a topside launch and recovery device.

SUMMARY OF THE INVENTION

The invention is set forth and characterized in the main claim, while the dependent claims describe other characteristics of the invention.

It is thus provided a system for managing and controlling a subsea module, characterized by a deployment module configured for releasably receiving and accommodating the subsea module, and further comprising a load-bearing cable, one end of which is connected to the subsea module, and the other end of which is connected to a cable control device on the deployment module, whereby the subsea module may be lowered out of and retracted into the deployment module. In one embodiment, the load-bearing cable is a load-bearing umbilical cable.

In one embodiment, the deployment module comprises power distribution and control means, communication means, configured for communication with a control facility. The deployment module may comprise a power and signal cable, configured for connection to a power and signal interface unit on a carrier structure. The deployment module may comprise lifting means, configured for suspending the deployment module.

In one embodiment, the subsea module is configured for holding a subsea vehicle. In one embodiment, the vehicle comprises a remotely operated vehicle (ROV). The subsea module may further comprise a tether management system (TMS) and a tether connected between the ROV and the TMS.

In one embodiment, the vehicle comprises an autonomous underwater vehicle (AUV).

In one embodiment, the subsea module comprises a remotely operated tool (ROT). The remotely operated tool may comprise utilities-and-power means to perform work on subsea or downhole equipment or installations. The remotely operated tool may comprise a signal cable, hydraulic hose or other elongate flexible element configured for connection to the subsea or downhole equipment or installation (22).

It is also provided a method of operating the invented system, characterized by the steps of:

a) arranging the deployment module above a body of water and providing power and signals to the deployment module;
b) lowering the subsea module from the deployment module, via a load-bearing umbilical or wire, to a resident subsea location;
c) operating the subsea module for a desired duration; and
d) retrieving the subsea module to the deployment unit.

In the method, the deployment module may be placed on a carrier structure following step b). The deployment module is preferably arranged above the body of water prior to step d).

The resident subsea location may be on the seabed or a structure on the seabed.

In one embodiment of the invented method, the subsea module is controlled from a distal location, via the umbilical and the deployment module.

In one embodiment, the vehicle is controlled from a distal location, via the tether, the subsea module, the umbilical and the deployment module.

The invented system makes mobilization of an ROY, AUV and ROT more efficient, in terms of both cost and time, compared to the prior art systems. The invented system improves logistics operations, allows for more rapid mobilization, and occupies less space that prior art systems.

The invention may be used by any installation, facility, vessel or rig at sea, as well as on shoreline facilities, such as a quay or dock. The invention is self-contained, and requires only electrical power and signals, and lifting equipment, such that the seabed module may be lowered from the deployment module.

BRIEF DESCRIPTION OF THE DRAWINGS

These and other characteristics of the invention will become clear from the following description of an embodiment, given as a non-restrictive example, with reference to the attached schematic side-view drawings, wherein.

DETAILED DESCRIPTION OF AN EMBODIMENT

Figure 1:
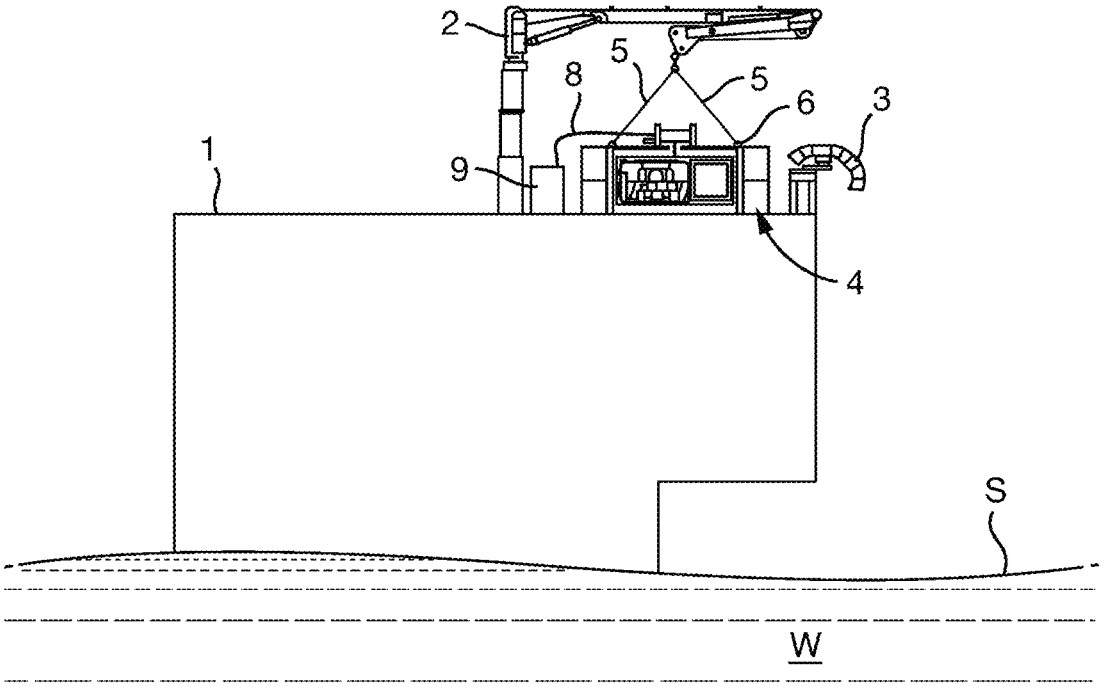
FIG. 1 shows an embodiment of the invented system, in an inactive state aboard a carrier structure, such as an offshore platform or ship, and connected to a crane.

The following description will use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

FIG. 1 shows an embodiment of the invented system, placed on the deck of a carrier structure 1. The carrier structure may for example be a ship, a floating platform, a fixed offshore, inshore or atshore installation, or a quay. The invented system comprises a deployment module 4, which is designated and configured for launching and recovering a subsea module, as will be described in the following. The term "deployment module" shall therefore not be limited to use only in a deployment operation, but also in a retrieval operation. The deployment module 4 is designed such that it is easily movable from one location to another. The deployment module may for example be mobilized from an onshore base on short notice, and transported by a supply vessel to an offshore rig. The deployment module 4 comprises lifting lugs 6, by means of which it may be lifted (e.g. by a crane 2 and associated lifting gear 5). The crane may, for example, be a regular deck crane, which is well known in the art. When placed on the carrier structure 1, the deployment module 4 is connected to an electrical power and signal interface unit 9 (e.g. a utility station) on the carrier structure.

Figure 2:
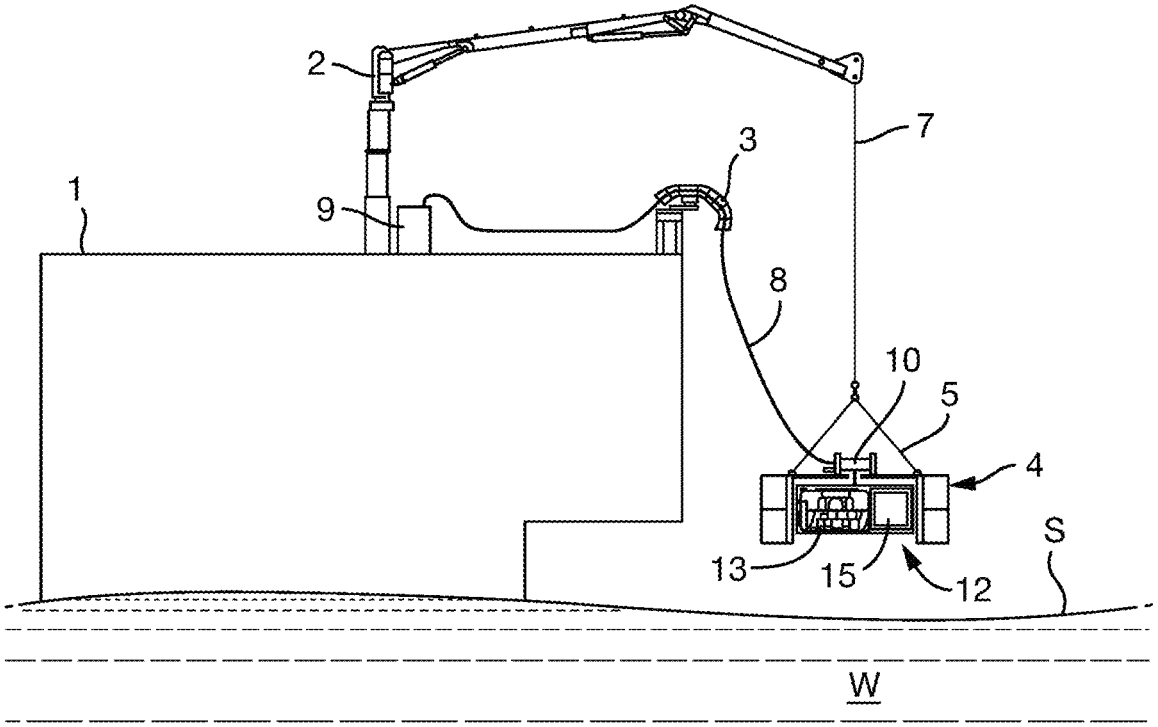
FIG. 2 shows the deployment module being suspended by the crane, above the water.
Figure 8:
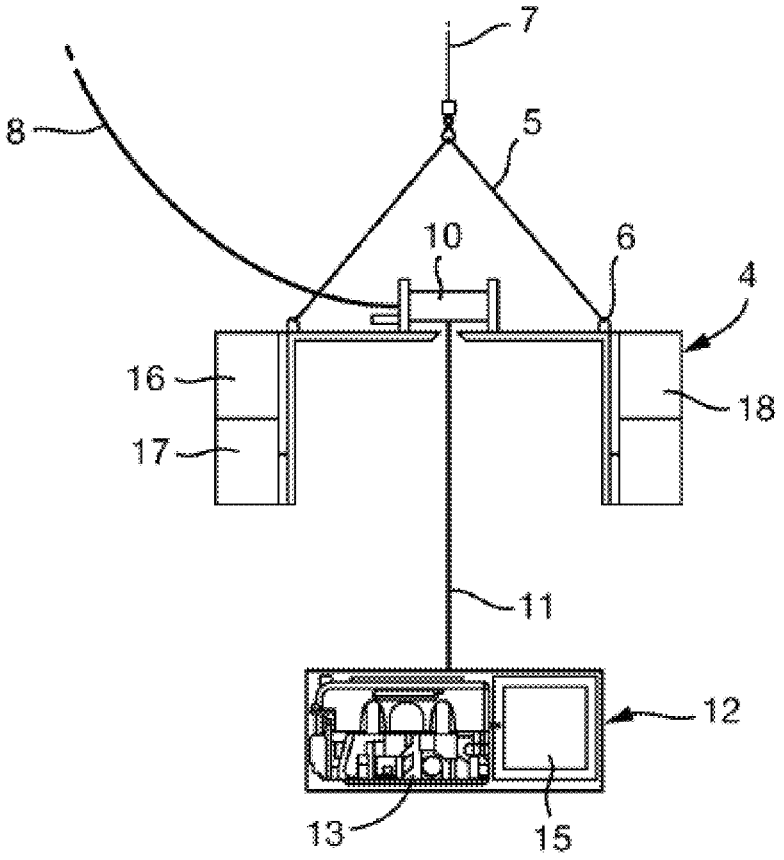
FIG. 8 is an enlarged drawing of the area marked "$A_2$" in FIG. 7.

Referring additionally to FIG. 2 and FIG. 8, the deployment module 4 comprises a chassis on which an umbilical winch 10 is arranged. The deployment module 4 also comprises interface means (e.g. a cage or housing) for a subsea module 12. The subsea module 12 is a device which is releasably connected to the deployment module 4 (by devices that are known per se) and is shown as being suspended by a load-bearing umbilical 11 which is being stored on the umbilical winch 10. Such umbilical cable is a well-known device for communicating power, control signals, etc., and needs therefore not be described in further detail here. It should be understood that the load-bearing umbilical cable may be replaced by a load-bearing wire or rope, or similar, in combination with a piggy-back control cable. In an inactive state for example during transportation and storage the subsea module 12 may be locked to the deployment module 4. The deployment module 4 may be formed with a designated bay or hold, into which the subsea module 12 will fit.

The deployment module 4 also comprises Power Distribution Units (PDU) 16, transformers 17 and a control and communications module 18. The deployment module is therefore a self-contained unit, only requiring power, signals and lifting means.

Figure 6:
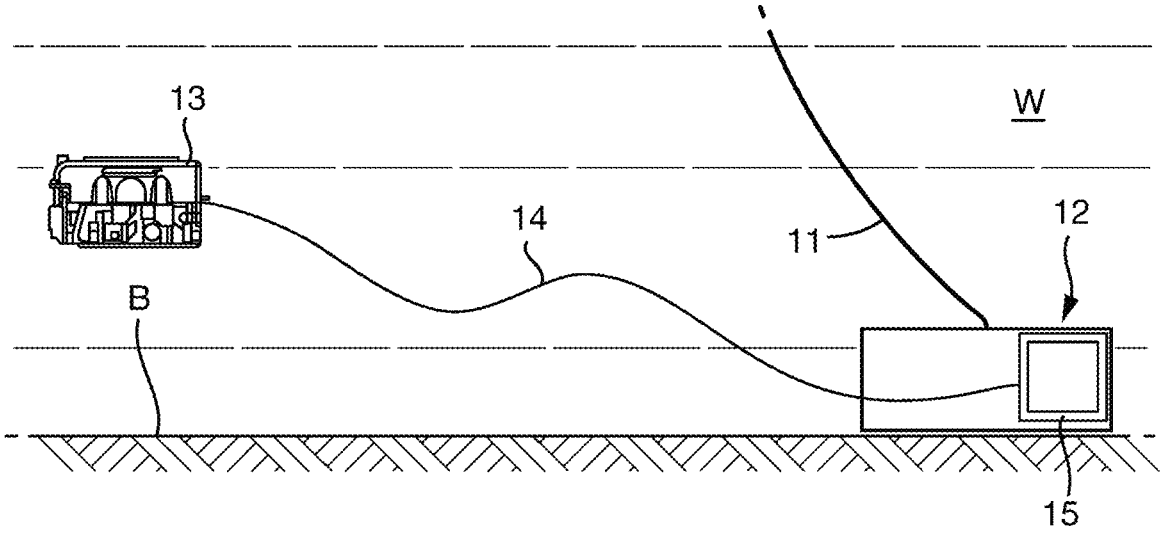
FIG. 6 is an enlarged drawing of the area marked "$A_1$" in FIG. 5.

Referring additionally to FIG. 6, the subsea module 12 comprises in the illustrated embodiment interface means (e.g. a cage or housing) for supporting a remotely operated vehicle (ROV) 13 and a tether management system (TMS) 15. The physical interfaces between the ROV, the TMS, and the subsea module utilize known devices, and need therefore not be described further here. The subsea module may comprise one or more holding stations for various ROV tools.

The ROV may be any suitable ROV known in the art, and need therefore not be described further here. Likewise, the TMS may be any suitable TMS known in the art and need therefore not be described further here. A tether 14 extends between the ROV 13 and TMS 12, in a manner which is well known in the art. It should be understood, however, that the invention is also applicable for wireless communication with the ROV A power and signal cable 8 is connected between the deployment module 4 and the power and signal interface unit 9 on the carrier structure 1, thus providing electrical power to the umbilical winch and equipment such as the PDU 16, transformers 17 and the control and communications module 18.

A method of using the invented system in the illustrated embodiment will now be described:

Referring to FIG. 1, the self-contained deployment module 4 has been placed on the deck of a carrier structure 1 (e.g. an offshore rig, a floating platform, a fixed installation, a quay), and lifting gear 5 has been attached to the crane 2. The power-and-signal cable 8 has been connected to a utility station 9.

Referring to FIG. 2, the crane 1 has lifted the deployment module 4, via the lifting gear 5 and crane wire 7, and is suspending the deployment module 4 above the water surface S. The cable 8 supplies electrical power and signals to the deployment module 4 and its onboard equipment, including the umbilical winch 10. The cable is placed in a chute 3. The subsea module may be operated by an operator located on the carrier structure, either via the cable 8 or by wireless connection, which per se is known in the art.

Figure 3:
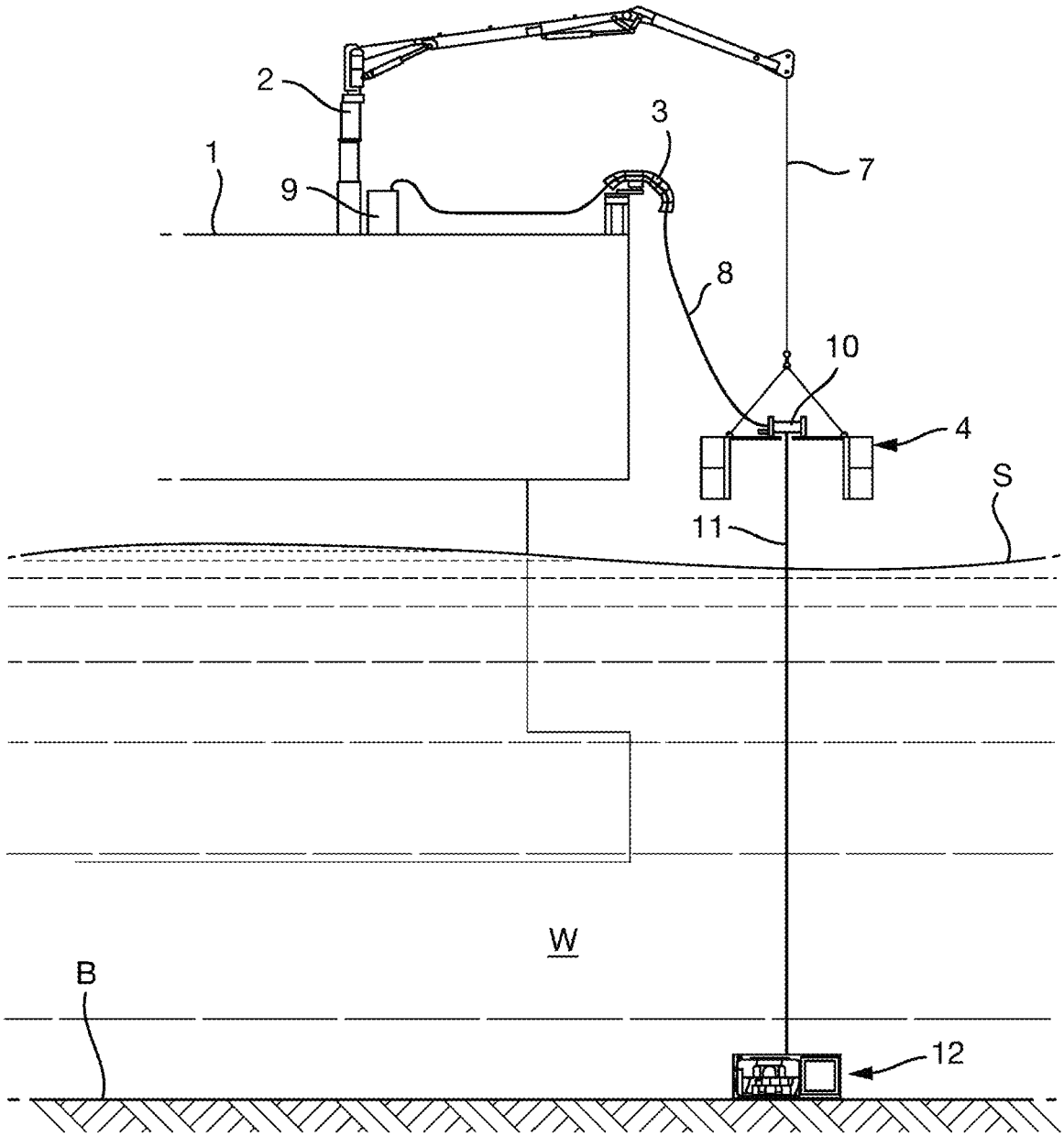
FIG. 3 shows a subsea module having been lowered to the seabed via an umbilical, from the deployment module.

Referring to FIG. 3, the subsea module 12 has been lowered from the deployment module 4, by means of the winch 10 and via the load-bearing umbilical 11, to the seabed B.

Figure 4:
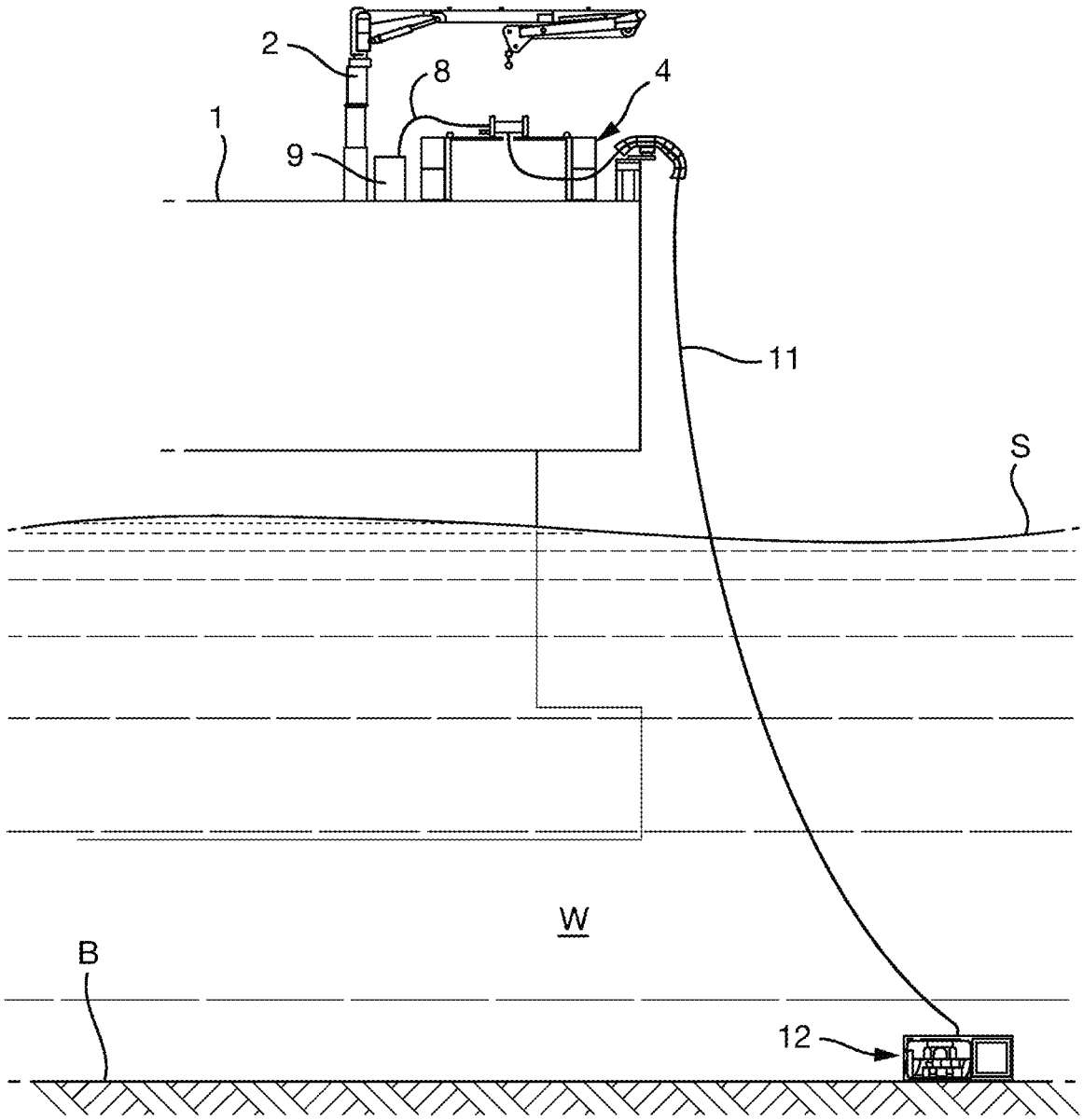
FIG. 4 shows the deployment module having been moved back to, and placed on, the carrier structure and the subsea module is resting on the seabed, and an umbilical extends between the deployment module and the subsea module.

Referring to FIG. 4, the deployment module 4 has been hoisted back onto the rig 1, and the umbilical 11 has been placed in the chute. The deployment module 4 is connected to the power and signal interface unit 9 via the cable 8, whereby signals to and from the subsea module may be communicated to and from the signal interface unit 9, and hence to control stations and monitoring equipment on the carrier stricture. The subsea module 12 is now resident Oil the seabed, and ready to commence operation. The subsea module may be resident for long or short durations, depending on the requirements of the operation.

Figure 5:
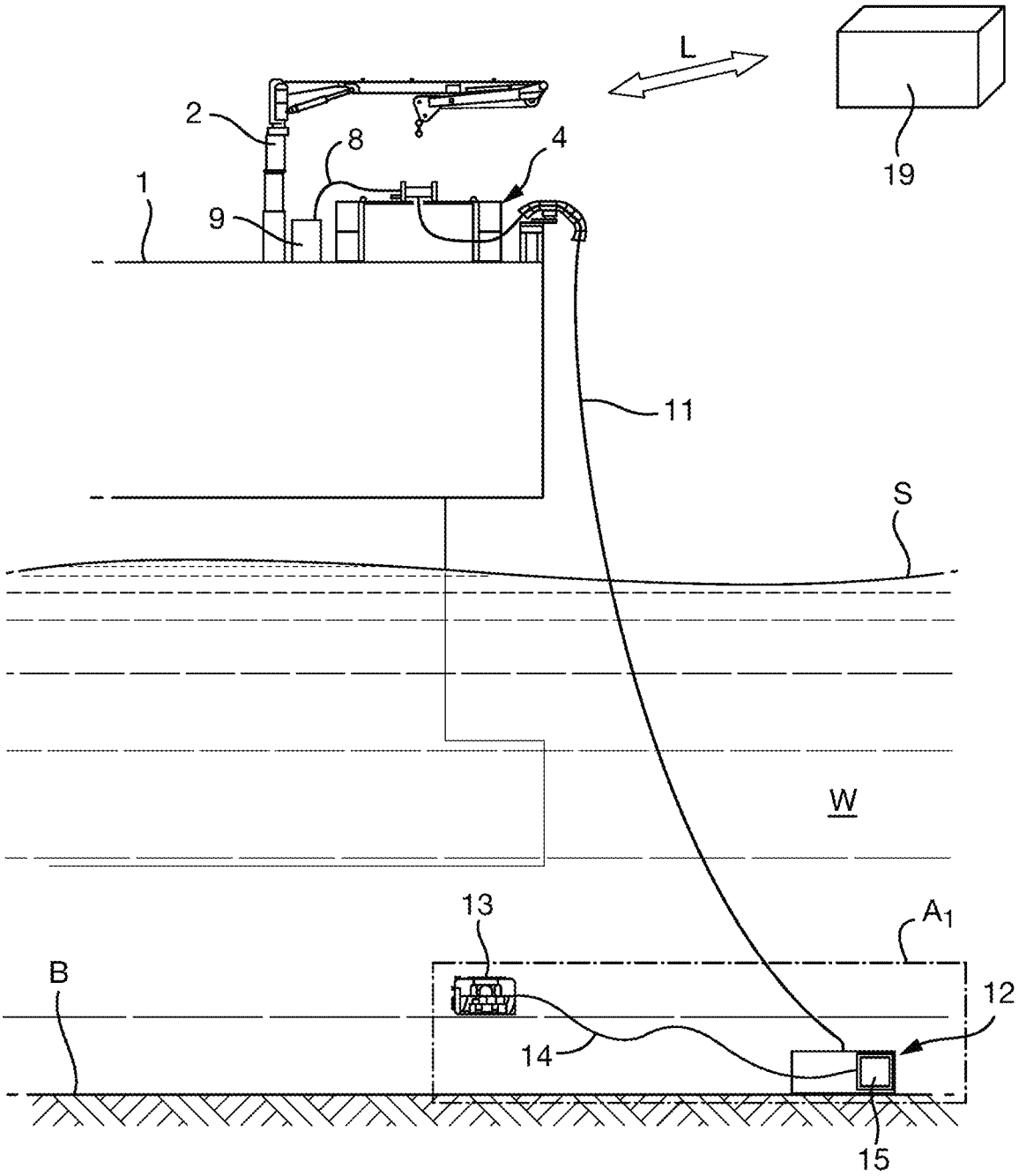
FIG. 5 shows the deployment module in place on the carrier structure and the subsea module resting on the seabed, and an ROV is moving in the water, connected to the TMS in the subsea module via a tether.

Referring to FIG. 5 and FIG. 6, the ROY 13 is moving in the water W, connected to the TMS 15 on the subsea module 12 via a tether 14, The ROY is thus operated and controlled by signals through the umbilical 11 to the subsea module 12 and TMS 15, and the tether 14. The ROY may thus be controlled, monitored or operated from a distal location, fix example a control room on the rig 1, or on a different vessel or on an onshore location.

The communication between the deployment module 4 and a control room may be via the cable 8 (discussed above), or by wireless means L (e.g. 4G telephone or satellite network). Such wireless communication may be useful if the control room 19 is at a distal location (e.g. an onshore site), but may also be used to communicate with nearby facilities (e.g. a vessel or rig). Such means of wireless communication are well known in the art and need therefore not be described in further detain here.

Figure 7:
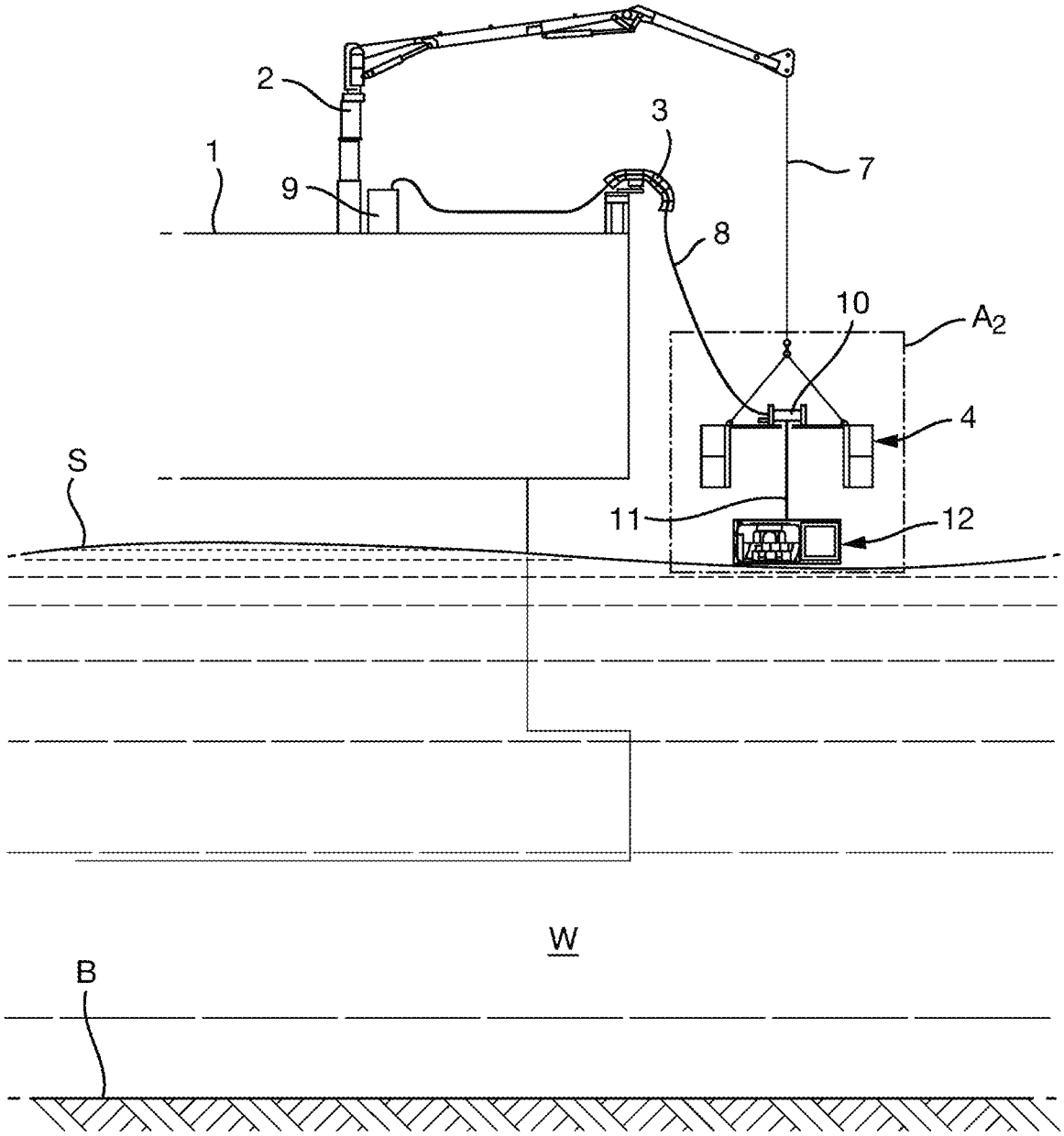
FIG. 7 shows the deployment module suspended above the water by the carrier structure crane, and the subsea module suspended underneath the deployment module by the umbilical.

Referring to FIG. 7 and FIG. 8, the subsea module 12 is being retrieved (recovered) in a manner similar to its deployment (launch), only in reverse order. The winch 10 is hauling the subsea module 12 (holding the ROV 13 and the TMS 15) via the umbilical 11, into the deployment module 4, whereupon the deployment module 4 is placed on the rig deck, corresponding to the situation illustrated in FIG. 1.

Although the invention has been described with the use of a crane 2 and lifting gear 5, 6, it should be understood that the invention is not limited to an overboarding device. In an alternative embodiment (not illustrated), the deployment module 4 may be placed on a balcony or above a moon-pool or other deck opening and remain there during the ROV operations, whereby the subsea module 12 may be lowered into the sea without a preceding crane operation.

Although the invention has been described with the subsea module 12 resting on the seabed when the ROV 13 is in operation, it should be understood that the invention is not limited to the subsea module being in such position. The subsea module may rest on (or be connected to) other structures, and/or it may be equipped with buoyancy modules (not shown), whereby is may be made neutrally buoyant. The connection to other structures may be by mechanical devices and/or by magnetic devices (e.g. electromagnets).

Although the invention has been described with reference to a subsea module carrying an ROV and a TMS, it should be understood that the invention is equally applicable for a subsea module carrying any unmanned undersea vehicle, such as an AUV or a non-tethered ROV.

Figure 9:
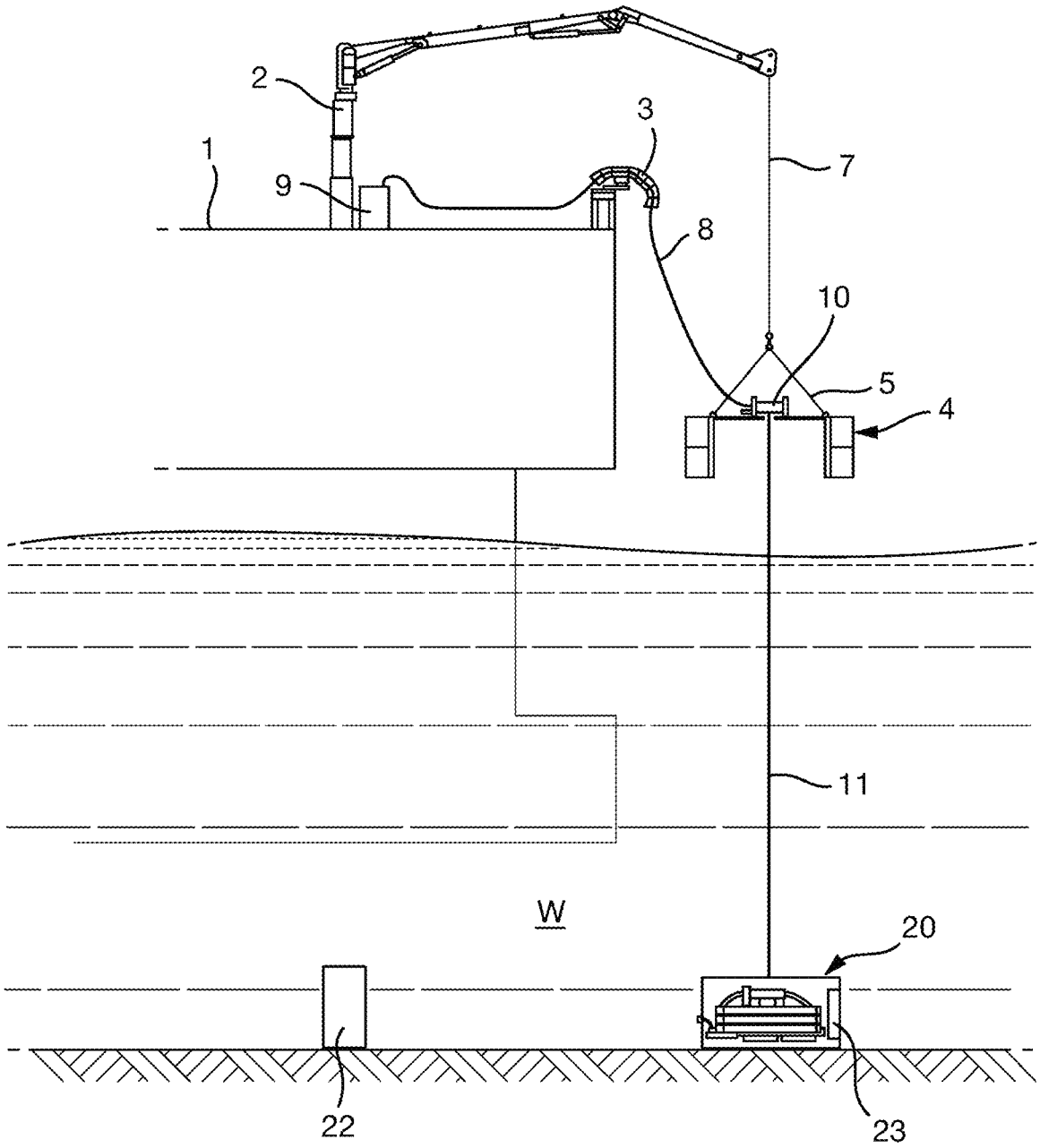
FIG. 9 corresponds to FIG. 3, but illustrates an alternative embodiment of the subsea module.
Figure 10:
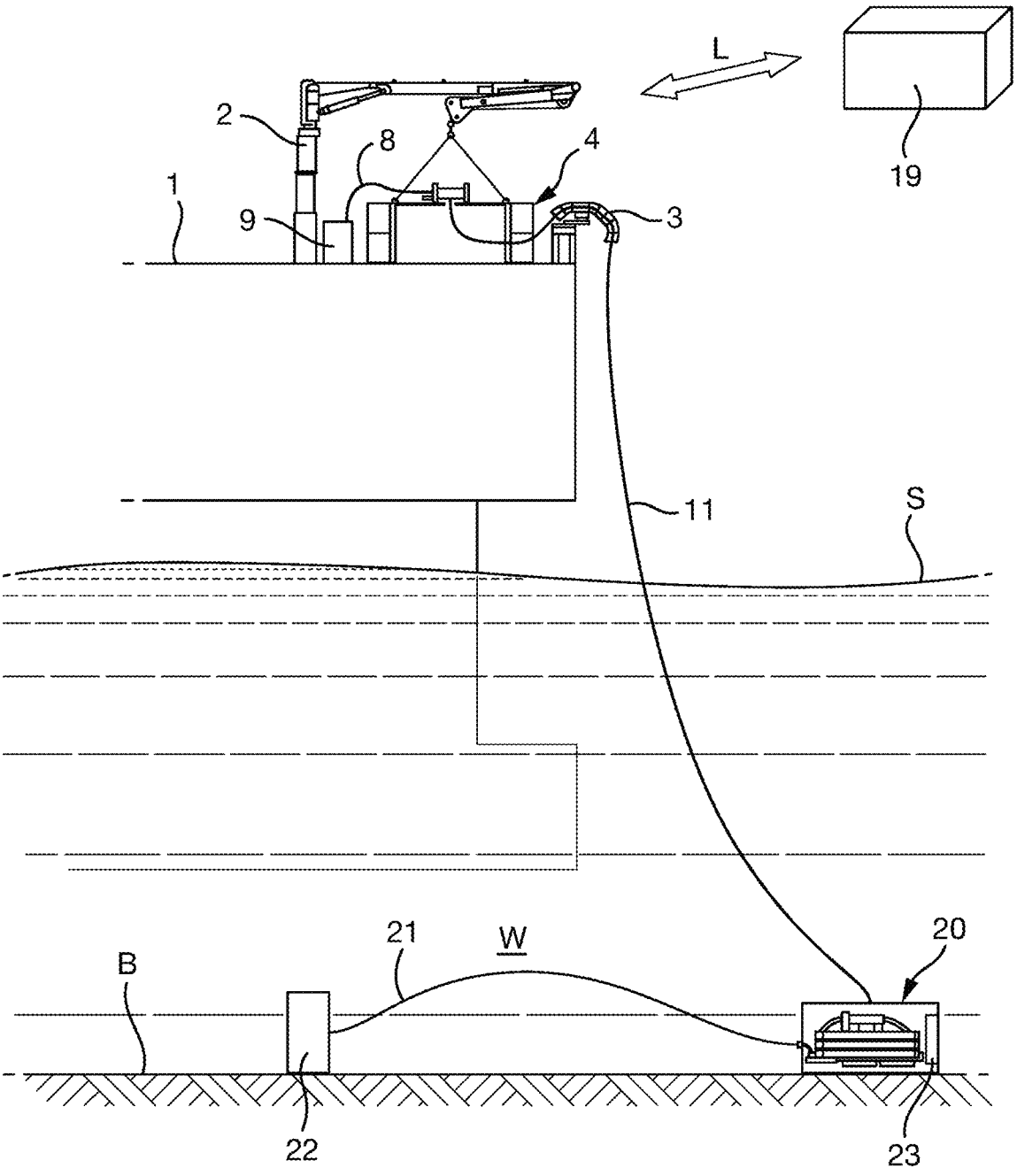
FIG. 10 shows the deployment module in place on the carrier structure and the alternative embodiment of the subsea module resting on the seabed, and a cable, hose or similar is connected to a subsea installation.

Referring to FIGS. 9 and 10, the subsea module 12 as described above may be replaced by an alternative embodiment of a subsea module 20. This subsea module 20 may be any remotely operated tool (ROT), for example a BOP intervention tool or a wellhead tool. The ROT 20 is deployed from, and retrieved back into, the deployment module 4 in a manner similar to what is described above with reference to the subsea module 12, and also operated via similar means. Only the differences between the two embodiments of the subsea module are therefore described in the following.

FIG. 9 illustrates the ROT 20 having been placed on the seabed, in the vicinity of a seabed installation 22, for example a BOP. In FIG. 10, the deployment module 4 has been moved back onto the carrier 1, and a cable 21 has been extended between the seabed installation 22 and the ROT 20. In should be understood that the cable 21 in fact may be any elongate element, such as a control cable, power cable, umbilical, hydraulic hose, or similar, depending on the actual requirement for the case at hand. Reference number 23 schematically indicates utilities-and-power means, which may comprise e.g. electrical motors, hydraulic accumulators, control devices, pumps, or other mechanical or hydraulic power means.

The invention claimed is:

1. A system for managing and controlling a subsea module comprising:

a deployment module having lifting lugs and a chassis on which an umbilical winch is arranged, and a first interface for releasably receiving and accommodating the subsea module; wherein the deployment module is configured to be placed on a carrier structure and connected to an electrical power and signal interface unit on the carrier structure, the carrier structure being one of a ship, a floating platform; a fixed offshore, inshore or atshore installation, or a quay;

a load-bearing umbilical cable or a load-bearing wire or rope in combination with a piggy-back control cable, one end of which is connected to the subsea module and the other end of which is connected to the umbilical winch on the deployment module, wherein the subsea module may be lowered out of and retracted into the deployment module;

wherein the deployment module is configured to be placed on the carrier structure when the subsea module is at a subsea location.

2. The system of claim 1, wherein the deployment module comprises power distribution and control portion, and a communication portion configured to communicate with a control facility.

3. The system of claim 2, wherein the communication portion further comprises a control and communications module configured to communicate with a control room at a distal location.

4. The system of claim 1, wherein the deployment module comprises a power and signal cable, configured to connect with a power and signal interface unit on the carrier structure.

5. The system of claim 1, further comprising a wireless communication portion configured to communicate with a control room at a distal location.

6. The system of claim 1, wherein the deployment module comprises a lifting apparatus, configured to suspend the deployment module.

7. The system of claim 1, wherein the subsea module is configured to hold a subsea vehicle.

8. The system of claim 7, wherein the subsea vehicle comprises a remotely operated vehicle (ROV).

9. The system of claim 8, wherein the subsea module further comprises a tether management system (TMS) and a tether connected between the ROV and the TMS.

10. The system of claim 7, wherein the subsea vehicle comprises an autonomous underwater vehicle (AUV).

11. The system of claim 1, wherein the subsea module is a remotely operated tool (ROT).

12. The system of claim 11, wherein the ROT comprises a utilities-and-power apparatus to perform work on a subsea or downhole equipment or installation.

13. The system of claim 12, wherein the remotely operated tool comprises a signal cable, hydraulic hose, or other elongate flexible element configured to connect to the subsea or downhole equipment or installation.

14. A method of operating the system as defined by claim 1, the method comprising:

arranging the deployment module above a body of water and providing power and signals to the deployment module;

lowering the subsea module from the deployment module, via the load-bearing umbilical cable or load bearing wire or rope, to a resident subsea location;

operating the subsea module for a desired duration; and retrieving the subsea module to the deployment module.

15. The method of claim 14, wherein the arranging of the deployment module comprises suspending the deployment module via a crane.

16. The method of claim 14, wherein the deployment module is placed on the carrier structure after the subsea module is lowered from the deployment module via the said load-bearing umbilical cable, or load bearing wire or wire, to the resident subsea location.

17. The method of claim 14, wherein the arranging of the deployment module above the body of water and providing the power and signals to the deployment module further comprises placing the deployment module on a balcony or above a moon-pool or other deck opening.

18. The method of claim 14 wherein the deployment module is arranged above the body of water prior to retrieving the subsea module to the deployment module.

19. The method of claim 14, wherein the resident subsea location is on the seabed or on a structure on a seabed.

20. The method of claim 14, wherein the subsea module is controlled from a distal location, via an umbilical and the deployment module.

21. The method of claim 14, wherein a subsea vehicle is controlled from a distal location, via a tether, the subsea module, an umbilical and the deployment module.

* * * * *